US006415603B1

(12) United States Patent
Nowka et al.

(10) Patent No.: US 6,415,603 B1
(45) Date of Patent: Jul. 9, 2002

(54) FLEXIBLE CONNECTOR ASSEMBLY

(75) Inventors: Erich James Nowka, Ann Arbor; Mark Allen Blaha, Canton, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/682,670

(22) Filed: Oct. 4, 2001

(51) Int. Cl.[7] ..... F01N 7/10

(52) U.S. Cl. ..... 60/322; 60/299; 60/323; 285/223; 285/226; 285/227

(58) Field of Search ..... 60/322, 312, 323, 60/324, 313, 299; 285/223, 226, 227

(56) References Cited

U.S. PATENT DOCUMENTS

| | | | | | |
|---|---|---|---|---|---|
| 3,841,842 | A | * | 10/1974 | Wiley | 23/288 |
| 3,892,537 | A | * | 7/1975 | Gulati et al. | 23/288 |
| 3,966,419 | A | * | 6/1976 | Bloomfield | 23/288 |
| 4,155,980 | A | * | 5/1979 | Santiago et al. | 422/180 |
| 5,069,487 | A | * | 12/1991 | Sheppard | 285/226 |
| 5,159,811 | A | | 11/1992 | Hefler et al. | |
| 5,323,989 | A | * | 6/1994 | Hamada et al. | 248/60 |
| 5,340,165 | A | * | 8/1994 | Sheppard | 285/226 |
| 5,941,070 | A | * | 8/1999 | Oldham | 60/322 |
| 5,988,308 | A | * | 11/1999 | Qutub | 180/309 |
| 6,058,702 | A | * | 5/2000 | Jorg Alexnat et al. | 60/322 |
| 6,173,800 | B1 | | 1/2001 | Steenackers et al. | |
| 6,178,744 | B1 | | 1/2001 | Perset | |
| 6,185,932 | B1 | | 2/2001 | Park et al. | |
| 6,192,675 | B1 | | 2/2001 | Hirota et al. | |

FOREIGN PATENT DOCUMENTS

| | | |
|---|---|---|
| DE | 3111116290 A1 | 11/1982 |
| FR | 2504645 | 10/1982 |
| FR | 2694600 | 2/1994 |
| JP | 57-151014 | 9/1982 |
| JP | 58-101214 | 6/1983 |

* cited by examiner

*Primary Examiner*—Thomas Denion
*Assistant Examiner*—Binh Tran
(74) *Attorney, Agent, or Firm*—Allan J. Lippa; John D. Russell

(57) ABSTRACT

A connector assembly for connecting a catalytic converter assembly to a muffler and tailpipe assembly includes first and second flexible portions, and a middle portion disposed between the flexible portions. The middle portion includes a catalyst element for modifying exhaust gases passing from the catalyst assembly to the muffler and tailpipe assembly.

18 Claims, 2 Drawing Sheets

FLEXIBLE CONNECTOR ASSEMBLY

BACKGROUND OF INVENTION

1. Field of the Invention

The invention relates to flexible connector assemblies for use with vehicle exhaust systems.

2. Background Art

An exhaust system for use with a vehicle having a transverse mounted engine typically includes a catalytic converter assembly attached to one or more exhaust manifolds of the engine, and configured to purify exhaust gases passing from the engine. The exhaust system further includes a muffler and tailpipe assembly attached to the catalytic converter assembly with a flexible coupling. The flexible coupling allows the catalytic converter assembly to move with the engine and relative to the muffler and tailpipe assembly, which is typically fixedly secured to the vehicle.

One known flexible coupling includes a convoluted steel pipe surrounded by a stainless steel mesh. Another known flexible coupling includes two flexible portions each having a similar construction as described above, and a rigid stainless steel tube disposed between the flexible portions.

If enhanced emissions control is required, the exhaust system may also include a secondary catalytic converter disposed downstream of the flexible coupling. The secondary catalytic converter further purifies exhaust gases passing from the catalytic converter assembly. Because of packaging constraints, however, sufficient space may not be available for such a secondary catalytic converter.

SUMMARY OF INVENTION

The invention addresses the shortcomings of the prior art by providing a connector assembly that functions as a flexible coupling, and is also configured to purify exhaust gases.

Under the invention, a connector assembly for connecting a catalytic converter assembly to a muffler and tailpipe assembly includes first and second flexible portions and a middle portion disposed between the flexible portions. The middle portion includes a catalyst element for purifying exhaust gases passing from the catalyst assembly to the muffler and tailpipe assembly.

Because the catalyst element is provided as part of the connector assembly, additional space is not needed for a secondary catalytic converter. Furthermore, with such a configuration, the catalyst element is disposed closer to a vehicle engine as compared with prior secondary catalytic converters. As a result, the catalyst element may achieve light-off and fully functional operating temperatures more quickly than prior secondary catalytic converters.

The catalyst element may include any suitable catalyst, such as a metallic catalyst and/or a ceramic catalyst. Furthermore, the middle portion of the connector assembly may include a casing to which the catalyst element is attached. For example, one end of the catalyst element may be fixedly secured to the casing, and an opposite end of the catalyst element may be unattached to the casing.

Further under the invention, an exhaust system for use with a vehicle having an engine includes a catalytic converter assembly adapted to be connected to the engine, and a connector assembly connected to the catalytic converter assembly. The connector assembly includes first and second flexible portions and a middle portion disposed between the flexible portions. The first flexible portion is connected to the catalytic converter assembly. The middle portion has a catalyst element for purifying exhaust gases passing from the catalytic converter assembly. The exhaust system also includes a muffler and tailpipe assembly connected to the second flexible portion of the connector assembly. Furthermore, the connector assembly allows the catalytic converter assembly to move with respect to the muffler and tailpipe assembly.

These and other objects, features and advantages of the invention are readily apparent from the following detailed description of the preferred embodiments for carrying out the invention when taken in conjunction with the accompanying drawings.

DETAILED DESCRIPTION

Figure 1:
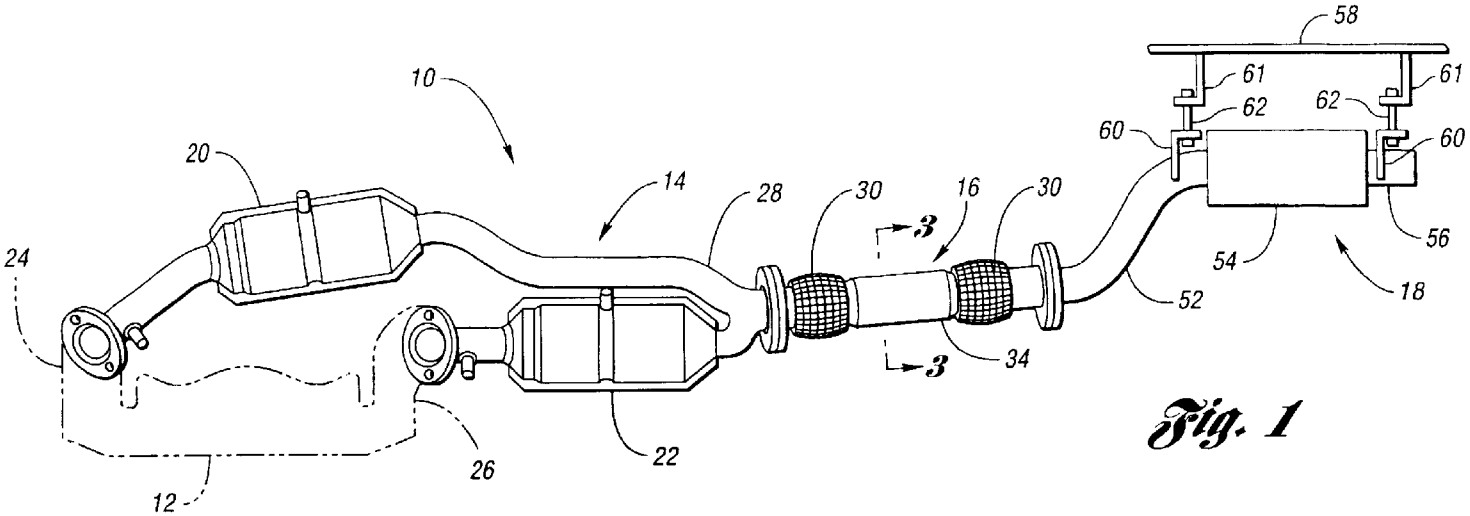
FIG. 1 is a top view of an exhaust system according to the invention including a catalytic converter assembly, a connector assembly connected to the catalytic converter assembly, and a muffler and tailpipe assembly connected to the connector assembly.

FIG. 1 shows an exhaust system 10 according to the invention for use with a vehicle having an engine 12. The exhaust system 10 includes a catalytic converter assembly 14, a flexible coupling, such as a connector assembly 16, connected to the catalytic converter assembly 14, and a muffler and tail pipe assembly 18 connected to the connector assembly 16.

The catalytic converter assembly 14 includes first and second primary catalytic converters 20 and 22, respectively, that are connected to first and second exhaust manifolds 24 and 26, respectively, of the engine 12. Each catalytic converter 20 and 22 is configured to purify exhaust gases produced by the engine 12. For example, each catalytic converter 20 and 22 is configured to modify or reduce at least some of the exhaust gases into harmless materials, such as carbon dioxide and water. The catalytic converters 20 and 22 are joined by a Y-shaped pipe 28 that is connected to the connector assembly 16. Alternatively, if the engine 12 includes only a single exhaust manifold, then the catalytic converter assembly 14 may include a single primary catalytic converter.

Figure 2:
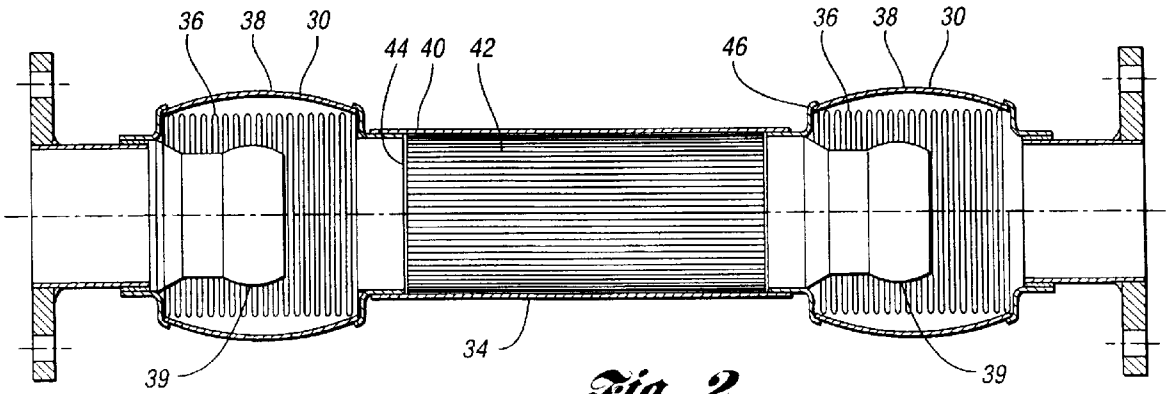
FIG. 2 is an axially extending cross-sectional view of the connector assembly shown in FIG. 1.

Referring to FIGS. 1 and 2, the connector assembly 16 includes first and second flexible portions such as joints 30 and 32, respectively, and a middle portion 34 disposed between and connected to the joints 30 and 32. With such a configuration, the connector assembly 16 allows the catalytic converter assembly 14 to move with respect to the muffler and tailpipe assembly 18. In the embodiment shown in FIGS. 1 and 2, the connector assembly 16 is not attached directly to the vehicle, but rather is suspended between the catalytic converter assembly 14 and the muffler and tailpipe assembly 18. While the connector assembly 16 may have any suitable length, in one embodiment of the invention, the connector assembly 16 has a length in the range of 45.72 to 60.96 centimeters (18 to 24 inches).

Each of the joints 30 and 32 includes a corrugated or convoluted pipe 36 and an outer cover 38 that extends over the convoluted pipe 36. While each convoluted pipe 36 and each cover 38 may comprise any suitable material or materials, in one embodiment of the invention, each convoluted pipe 36 comprises steel, and each cover 38 comprises a braided stainless steel mesh. Each joint 30 and 32 may also include an inner pipe 39 for directing exhaust gases through the joint 30 and 32. Alternatively, the joints 30 and 32 may each have any suitable configuration that is sufficiently flexible, such that the catalytic converter assembly 14 may move with respect to the muffler and tailpipe assembly 18.

The joints 30 and 32 may be attached to the middle portion 34 in any suitable manner. For example, each joint 30 and 32 may be welded to the middle portion 34. Furthermore, the first joint 30 may be attached to the catalytic converter assembly 14 in any suitable manner, such as by welding and/or bolting a flanged section of the first joint 30 to the pipe 28.

The middle portion 34 includes an outer casing, such as a pipe 40, and a catalyst element or substrate 42 disposed within the outer pipe 40 and configured to purify exhaust gases passing through the connector assembly 16. For example, the catalyst substrate 42 may react with the exhaust gases, in the presence of sufficient heat, to convert or otherwise modify some of the exhaust gases into harmless materials, such as carbon dioxide and water.

The catalyst substrate 42 is preferably attached to the outer pipe 40. For example, the catalyst substrate 42 may have a fixed first end 44 that is attached to the outer pipe 40, and a free second end 46 that is not attached to the outer pipe 40. With such a configuration, the catalyst substrate 42 is able to expand and contract lengthwise in response to temperature changes within the connector assembly 16. While the first end 44 may be attached to the outer pipe 40 in any suitable manner, in one embodiment of the invention, the first end 44 is brazed to the outer pipe 40.

Figure 3:
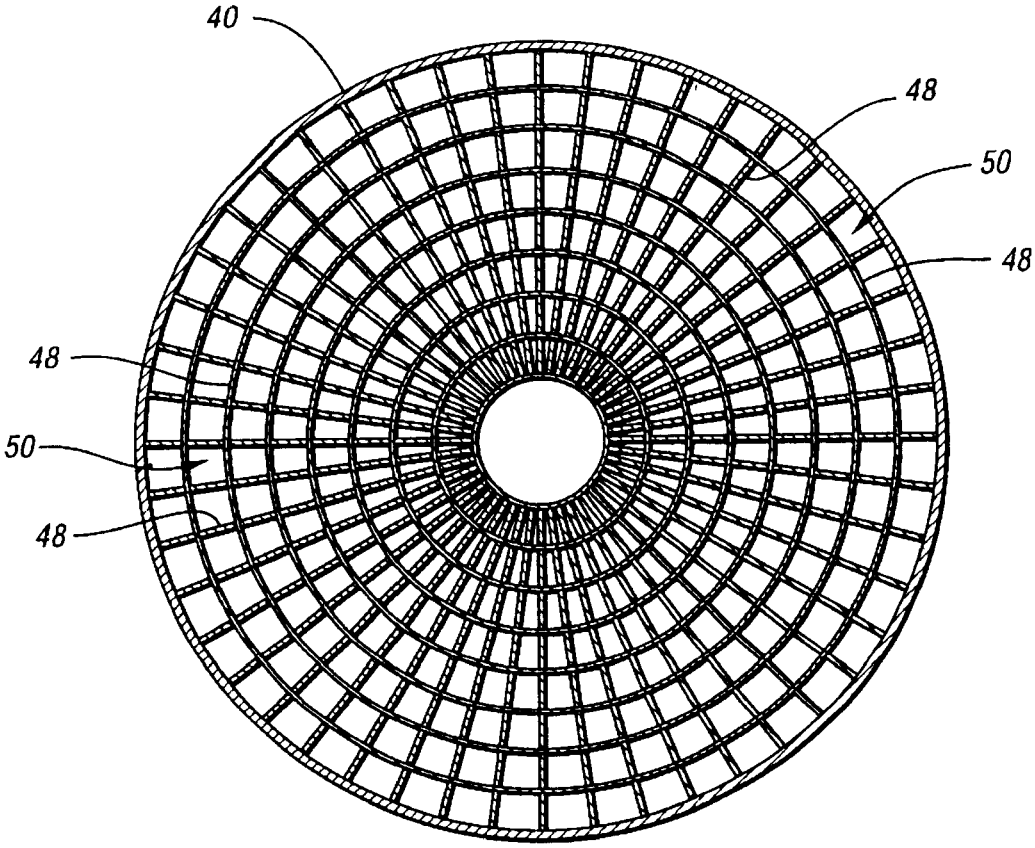
FIG. 3 is a cross-sectional view of the connector assembly taken along line 3—3 of FIG. 1.

Referring to FIGS. 2 and 3, the catalyst substrate 42 may be a metallic catalyst having a plurality of thin metallic foils or sheets 48 that may comprise any suitable metal such as stainless steel. The sheets 48 cooperate to define a plurality of channels 50 that are configured to allow exhaust gases to pass from the catalytic converter assembly 14 to the muffler and tailpipe assembly 18. The catalyst substrate 42 may also include a suitable chemical coating, such as a chemical coating comprising one or more of platinum, pladium and rhodium, that is applied on the sheets 48. Such a chemical coating assists in purification of exhaust gases passing through the connector assembly 16 by reacting with the exhaust gases, in the presence of sufficient heat, to convert or otherwise modify some of the exhaust gases into harmless materials, such as carbon dioxide and water. Alternatively, the catalyst substrate 42 may include any suitable catalyst or catalysts, such as a ceramic catalyst or a combination of ceramic and metallic catalysts.

Returning to FIG. 1, the muffler and tailpipe assembly 18 includes an exhaust pipe 52 connected to the second joint 32 in any suitable manner. For example, the exhaust pipe 52 may be welded and/or bolted to a flanged section of the second joint 32. The muffler and tailpipe assembly 18 further includes a muffler 54 connected to the exhaust pipe 52, and a tailpipe 56 connected to the muffler 54. The muffler and tailpipe assembly 18 is preferably fixedly secured to a body of the vehicle, such as a vehicle frame or floor pan 58. For example, the muffler and tailpipe assembly 18 may be attached to the floor pan 58 using brackets 60 and 61 and isolators 62, such as rubber isolators. The brackets 60 may be welded or otherwise secured to the muffler and tailpipe assembly 18, and the brackets 61 may be welded or otherwise secured to the floor pan 58.

Advantageously, the connector assembly 16 allows the engine 12 and catalytic converter assembly 14 to move with respect to the muffler and tailpipe assembly 18 during operation of the vehicle. In addition, the connector assembly 16 functions to further purify exhaust gases passing from the catalytic converter assembly 14.

Because the catalyst element 42 is provided as part of the connector assembly 16, additional space is not needed for a secondary catalytic converter. Furthermore, with such a configuration, the catalyst element 42 is disposed closer to the engine 12, which functions as a heat source, as compared with prior secondary catalytic converters. As a result, the catalyst element 42 may achieve light-off and fully functional operating temperatures more quickly than prior secondary catalytic converters. The light-off temperature may be in the range of 260 to 315° C. (500 to 600° F.), while the fully functional operating temperature may be in the range of 482 to 1010° C. (900 to 1850° F.).

While the best mode for carrying out the invention has been described in detail, those familiar with the art to which this invention relates will recognize various alternative designs and embodiments for practicing the invention as defined by the following claims.

What is claimed is:

1. A connector assembly for connecting a catalytic converter assembly to a muffler and tailpipe assembly, the catalytic converter assembly including at least one catalytic converter, the connector assembly comprising:

first and second flexible portions, the first flexible portion being adapted to be connected to the catalytic converter assembly, the second flexible portion being adapted to be connected to the muffler and tailpipe assembly; and a middle portion disposed between the flexible portions, the middle portion including a catalyst element for modifying exhaust gases passing from the catalytic converter assembly to the muffler and tailpipe assembly;

wherein the connector assembly is adapted to be suspended between the catalytic converter assembly and the muffler and tailpipe assembly such that the connector assembly allows the catalytic converter assembly to move with respect to the muffler and tailpipe assembly.

2. The connector assembly of claim 1 wherein the catalyst element includes a metallic catalyst.

3. The connector assembly of claim 1 wherein the catalyst element includes a ceramic catalyst.

4. The connector assembly of claim 1 wherein the middle portion is rigid and includes a casing to which the catalyst element is attached.

5. The connector assembly of claim 4 wherein the catalyst element has first and second ends, one of the ends being fixedly secured to the casing, and the other end being unattached to the casing.

6. The connector assembly of claim 4 wherein the casing comprises stainless steel.

7. An exhaust system for use with a vehicle having an engine, the exhaust system comprising:

a catalytic converter assembly adapted to be connected to the engine and including at least one catalytic converter;

a connector assembly connected to the catalytic converter assembly, the connector assembly including first and second flexible portions and a middle portion disposed between the flexible portions, the first flexible portion being connected to the catalytic converter assembly, the middle portion including a catalyst element for modifying exhaust gases passing from the catalytic converter assembly; and a muffler and tailpipe assembly connected to the second flexible portion and adapted to be attached to the vehicle;

wherein the connector assembly is suspended between the catalytic converter assembly and the muffler and tailpipe assembly such that the connector assembly allows the catalytic converter assembly to move with respect to the muffler and tailpipe assembly.

8. The exhaust system of claim 7 wherein the catalyst element includes a metallic catalyst.

9. The exhaust system of claim 7 wherein the catalyst element includes a ceramic catalyst.

10. The exhaust system of claim 7 wherein the middle portion is rigid and includes a casing to which the catalyst element is attached.

11. The exhaust system of claim 10 wherein the catalyst element has first and second ends, one of the ends being fixedly secured to the casing, and the other end being unattached to the casing.

12. The exhaust system of claim 10 wherein the casing comprises stainless steel.

13. A vehicle comprising:

a vehicle body;

an engine;

a catalytic converter assembly connected to the engine and including at least one catalytic converter;

a connector assembly including first and second flexible portions and a middle portion disposed between the flexible portions, the first flexible portion being connected to the catalytic converter assembly, the middle portion including a catalyst element for modifying exhaust gases passing from the catalytic converter assembly; and a muffler and tailpipe assembly connected to the second flexible portion, the muffler and tailpipe assembly further being connected to the vehicle body;

wherein the connector assembly is not attached directly to the vehicle body and is suspended between the catalytic converter assembly and the muffler and tailpipe assembly such that the connector assembly allows the catalytic converter assembly to move with respect to the muffler and tailpipe assembly.

14. The vehicle of claim 13 wherein the catalyst element of the connector assembly includes a metallic catalyst.

15. The vehicle of claim 13 wherein the catalyst element of the connector assembly includes a ceramic catalyst.

16. The vehicle of claim 13 wherein the middle portion of the connector assembly is rigid and includes a casing to which the catalyst element is attached.

17. The vehicle of claim 16 wherein the catalyst element has first and second ends, one of the ends being fixedly secured to the casing, and the other end being unattached to the casing.

18. The vehicle of claim 16 wherein the casing comprises stainless steel.

* * * * *